US006279358B1

(12) United States Patent
Costa

(10) Patent No.: US 6,279,358 B1
(45) Date of Patent: Aug. 28, 2001

(54) SEAL WITH ANTI-THEFT DEVICE FOR ITEMS HAVING ROD-LIKE PORTIONS

(76) Inventor: Emilio Costa, Viale Trento, 81/B -, 36078 Valdagno (IT)

( * ) Notice: Subject to any disclaimer, the term of this patent is extended or adjusted under 35 U.S.C. 154(b) by 0 days.

(21) Appl. No.: 09/565,743

(22) Filed: May 8, 2000

Related U.S. Application Data

(63) Continuation of application No. PCT/EP99/06616, filed on Sep. 8, 1999.

(30) Foreign Application Priority Data

Sep. 10, 1998 (IT) ..... PD98A0211

(51) Int. Cl.[7] ..... E05B 65/00
(52) U.S. Cl. ..... 70/57.1; 292/307 R; 24/704.1
(58) Field of Search ..... 70/57.1–59, 14; 292/307 R; 24/704.1, 704.2

(56) References Cited

U.S. PATENT DOCUMENTS 4,670,950 * 6/1987 Wisecup et al. ..... 24/150 R
4,991,413 * 2/1991 Arnaldo ..... 70/58 X
5,119,652 * 6/1992 Costa ..... 70/57.1
5,140,836 8/1992 Hogan et al. ..... 70/57.1
5,437,172 * 8/1995 Lamy et al. ..... 70/57.1
5,680,681 * 10/1997 Fuss ..... 70/57.1 X

FOREIGN PATENT DOCUMENTS 297 14 034 U 10/1997 (DE) .
96 23123 8/1996 (WO) .

* cited by examiner

*Primary Examiner*—Suzanne Dino Barrett
(74) *Attorney, Agent, or Firm*—Guido Modiano; Albert Josif; Daniel O'Byrne

(57) ABSTRACT

A seal with anti-theft device for items having rod-like portions, particularly eyeglasses, comprising a hollow body suitable to contain an electronic signaling component and defining a contact surface for a rod-like portion. Two parallel and mutually opposite guides protrude from the body, each guide having at least one saw-tooth engagement surface for the irreversible sliding, at right angles to the contact surface, of a slider which has complementary saw-tooth engagement surfaces. The rod-like portion is retained between the contact surface and a parallel contact surface defined by the slider. The seal is provided with an annular gasket, in which the rod-like portion is to be inserted, which is arranged between the saw-tooth engagement surfaces of the slider and is rigidly coupled thereto by being monolithically provided with an annular tab which surrounds a portion thereof.

6 Claims, 3 Drawing Sheets

SEAL WITH ANTI-THEFT DEVICE FOR ITEMS HAVING ROD-LIKE PORTIONS

CROSS-REFERENCE TO RELATED APPLICATIONS

This application is a continuation of application No. PCT/EP99/06616 filed on Sep. 8, 1999.

BACKGROUND OF THE INVENTION

The present invention relates to an improved seal with anti-theft device for items having rod-like portions.

Said seal is particularly suitable for application to the temples of eyeglasses.

It is in fact well-known that eyeglasses are currently commonly provided, in points of sale, with adapted seals bearing a customization marking or more simply the trademark of the manufacturer.

In recent times, in particular, it is common to integrate in the seals an anti-theft device which is able to activate electronic alarm circuits which are usually located near the exits.

The seals usually comprise a box-like body from which a tab protrudes which is constituted by articulated consecutive elements and is shaped so that it can be folded up so as to define, together with the box-like body, a seat for containing the rod-like portion of the item to which the seal is to be applied.

An electronic signaling component of a per se known type is inserted in the box-like body.

Moreover, the seal has a slider which irreversibly engages a guide rigidly coupled to the box-like body.

The slider has a mushroom-shaped head which enters and slides in a complementarily shaped seat defined in the tab so as to lock the tab in the folded position.

In this manner, the rod-like portion is retained in the seat defined by the folding of the tab by means of the irreversible locking of the slider.

In particular, the slider slides at right angles to the rod-like portion on the surface, defined by the box-like body, on which said rod-like portion rests.

The temple is in fact retained by the head of the slider and by the edge of the tab and is therefore retained along a plane which is parallel to the contact surface.

Although this type of seal ensures many advantages, it however suffers drawbacks.

First of all, the fact must be noted that the structure of the body of the seal allows a reduced sliding range for the slider, to the point that the slider can reach the end of its stroke without conveniently locking the rod-like portion.

Accordingly, in this type of seal there is provided a limited range of rod-like portions which can be retained therein without mutual rotations occurring.

For example, many problems can occur in trying to apply the anti-theft seal to items whose rod-like portions have a particularly small cross-section.

In addition to this, the dimensions of the anti-theft seal applied for example to the temples of eyeglasses causes many difficulties linked to the operations performed in order to arrange the eyeglasses in the exhibitors located in the points of sale.

The seals in fact can be applied to a temple without ensuring the locking of the temple in the containment seat and despite preventing uncoupling by sliding they can however rotate easily with respect to said temple, moving into an inclined position and thus making it difficult to perform the operations for arranging the eyeglasses in the exhibitors.

Moreover, currently commercially available seals also cannot be applied to items which have considerably large rod-like portions, since the containment seat that they define has a rather small cross-section with respect to the overall dimensions of the seal.

Moreover, currently widely used seals can be reused only partially, since in order to disengage them from the portions to which they have been previously applied it is necessary to break the mushroom-shaped head of the slider and therefore it is necessary to have a replacement part for the slider before being able to reuse the seal by applying it to a new rod-like portion.

In order to solve the cited drawbacks, a seal with anti-theft device has been provided which comprises a hollow body suitable to contain an electronic signaling component and defining a contact surface for a rod-like portion.

Two parallel and mutually opposite guides protrude from the body, each guide having at least one saw-tooth engagement surface for the irreversible sliding, at right angles to the contact surface, of a slider which has complementary saw-tooth engagement surfaces.

The rod-like portion is retained between the contact surface and a parallel contact surface arrangement formed by the slider.

A first gasket is arranged and glued on the hollow body in the region between the two guides.

A second gasket is instead arranged and glued on the lower face of the slider, interposed between the complementary saw-tooth engagement surfaces.

Although this new seal has achieved the intended aim, it still suffers the drawback that when it is closed on the corresponding rod-like portion the two elastomeric gaskets produce considerable friction on it.

Under traction, the friction effect is so intense as to overcome the adhesion force of the adhesive and the gaskets easily break off.

Accordingly, it is simple for an ill-intentioned person to slide the seal off the product and steal it.

SUMMARY OF THE INVENTION

The aim of the present invention is to provide a seal with anti-theft device for items having rod-like portions which solves the above noted drawback.

Within the scope of this aim, an object of the present invention is to provide a seal with anti-theft device which is compact and cannot be slid off the item to which it is applied.

Another object of the present invention is to provide a seal with anti-theft device which can also be applied to rod-like portions having a small cross-section without the possibility of rotations or unwanted movements.

Another object of the present invention is to provide a seal with anti-theft device which can be applied without problems even to large rod-like portions.

Another object of the present invention is to provide a seal which can be fully reused after the item to which it was applied has been sold.

Another object of the present invention is to provide a seal with anti-theft device by means of which it is not possible to make the slider reach the end of its stroke without being able to lock the rod-like portion for which it is intended.

Another object of the present invention is to provide a seal with anti-theft device which can be applied simply and rapidly.

Another object of the present invention is to provide a seal with anti-theft device whose cost is comparable to that of conventional types.

This aim, these objects and others which will become apparent hereinafter are achieved by a seal with anti-theft device for items having rod-like portions, comprising a hollow body suitable to contain an electronic signaling component and defining a contact surface for a rod-like portion, two parallel and mutually opposite guides protruding from said body, each guide having at least one saw-tooth engagement surface for an irreversible sliding, at right angles to the contact surface, of a slider which has complementary saw-tooth engagement surfaces, said rod-like portion being retained between the contact surface and a parallel contact surface defined by the slider, characterized in that an annular gasket, in which the rod-like portion is to be inserted, is arranged between the saw-tooth engagement surfaces of the slider and is rigidly coupled thereto by being monolithically provided with an annular tab surrounding a portion thereof.

BRIEF DESCRIPTION OF THE DRAWINGS

Further characteristics and advantages of the present invention will become apparent from the description of two preferred embodiments, illustrated only by way of non-limitative example in the accompanying drawings, wherein.

DESCRIPTION OF THE PREFERRED EMBODIMENTS

Figure 1:
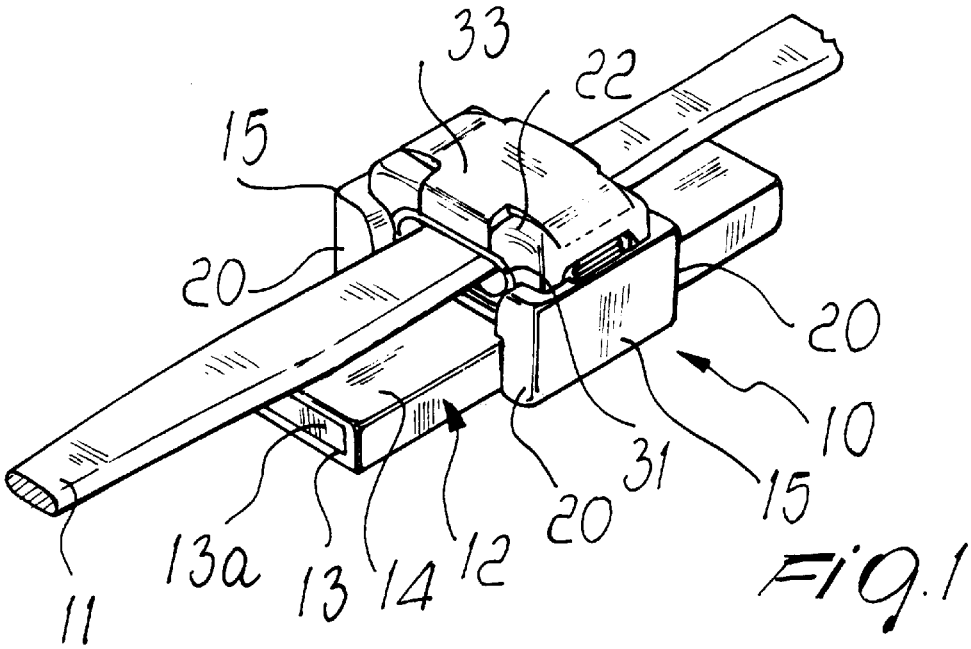
FIG. 1 is a perspective view of a first embodiment of a seal with anti-theft device, according to the invention, in the operating configuration.
Figure 2:
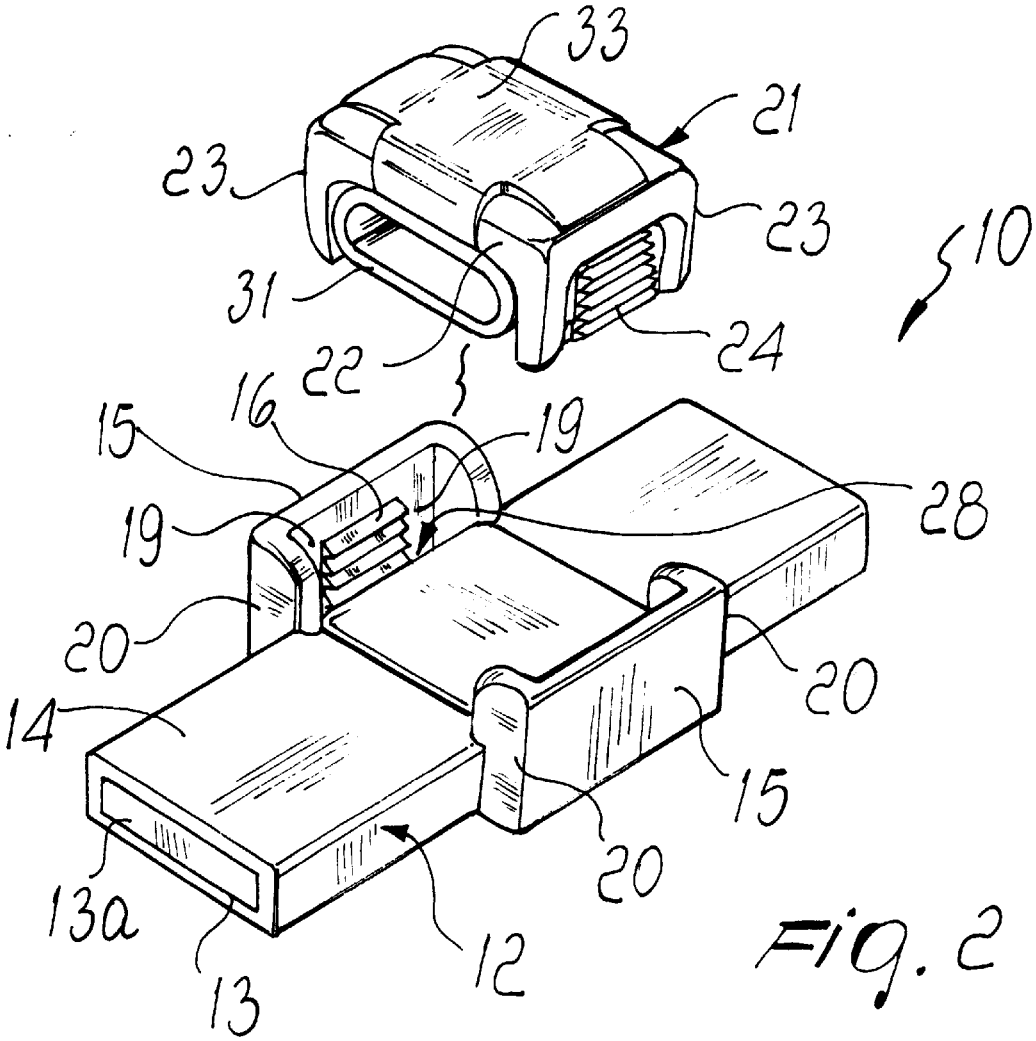
FIG. 2 is a perspective exploded view of the seal of FIG. 1, ready for use.
Figure 3:
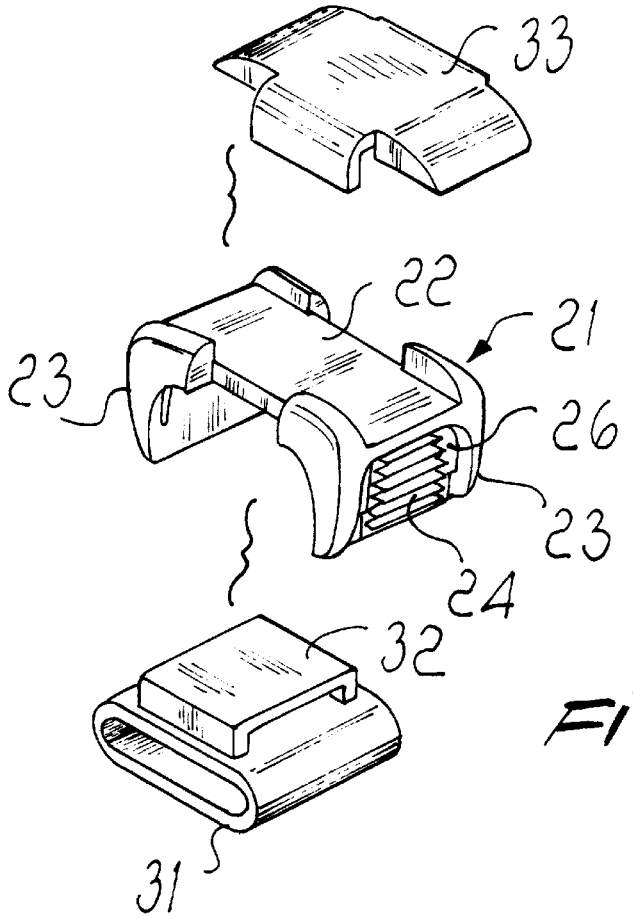
FIG. 3 is an exploded view of the seal with anti-theft device shown in FIG. 1.
Figure 4:
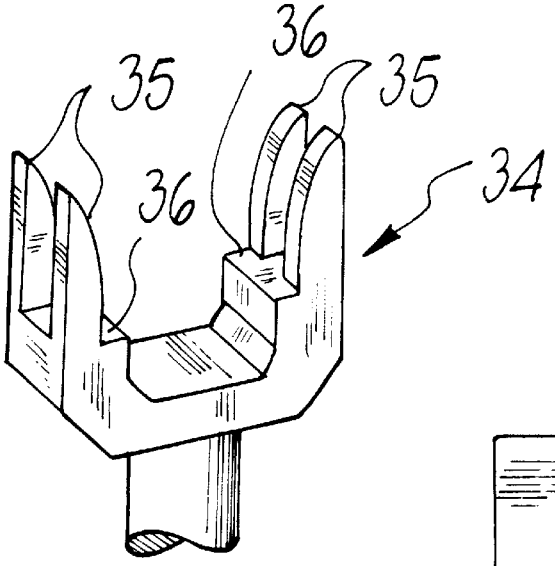
FIG. 4 is a perspective view of an extractor tool used to disengage a seal with anti-theft device from a rod-like portion to which it had been applied earlier.
Figure 5:
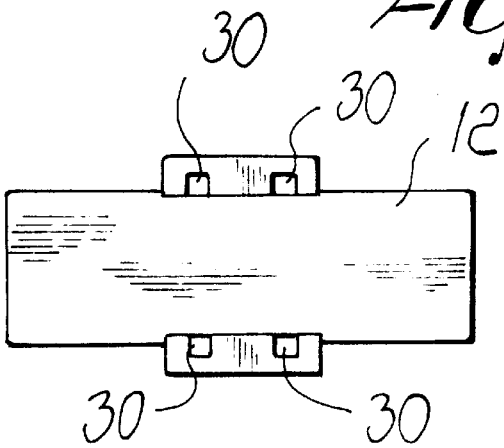
FIG. 5 is a bottom view of one of the components of the seal of FIG. 1.

With particular reference to FIGS. 1 to 7, a seal with anti-theft device for items having rod-like portions, according to the invention, is generally designated by the reference numeral 10 and is preferably made of plastics in a first embodiment.

In this case, the seal 10 is applied to a temple 11 of a pair of eyeglasses, not shown in the above figures for the sake of simplicity.

The seal 10 comprises a longitudinally elongated hollow body 12 in which there is provided, at one of the smaller faces, a slot 13 through which an electronic signaling component 13*a*, of a per se known type, is inserted and then sealed.

The body 12 defines, at a face 14, a contact surface for the temple 11.

Two mutually facing guides 15 protrude from the face 14 at a central region.

Each guide 15 is monolithic with respect to the body 12 and is substantially constituted by a wall which is perpendicular to the body 12 and in which, at the inward-facing side, there is provided at least one portion 16 with an inner saw-tooth surface.

The portion 16 is arranged between two narrow flat portions 19.

Blending portions 20, conveniently shaped so as to avoid sharp corners, protrude from the body 12 on the sides of each one of the guides 15.

The seal 10 is completed by a slider 21, which is also preferably made of plastics, is substantially bridge-shaped and has a flat portion 22 from the ends of which mutually parallel and facing wings 23 protrude at right is angles.

Internal regions 23*a* of the wings 23, that are adjacent to the flat portion 22, are separated from the rest by a through slot 23*b* which is shaped like an inverted letter U and causes them to be supported only at one end.

The regions 23*a* are therefore flexible.

Respective complementary saw-tooth portions 24 are defined on the outward face of each one of the wings 23 and are adapted to engage irreversibly the corresponding saw-tooth portions 16 defined on the guides 15.

Each one of the saw-tooth portions 24 is arranged between two flat regions 26 which are dimensionally equivalent to the corresponding flat regions 19 defined on each guide 15.

Advantageously, the saw-tooth portions 24 and the flat regions 26 are externally delimited by the slot 23*b*.

The slider 21 can slide, by means of the wings 23, along the guides 15 at right angles to the contact surface of the temple 11.

In particular, the sliding is irreversible and is performed by the saw-tooth portions 24, which mesh with, and continuously surmount, the saw-tooth protrusions of the portions 16.

A recess 28 is conveniently provided on the body 12, proximate to each guide 15 and starting from the face 14 and is related to the corresponding wing 23 of the slider 21.

Respective through holes 30 having a rectangular cross-section are provided in the bottom of each recess 28, at its ends, and are exactly aligned with the narrow flat portions 19 between which the saw-tooth portion 16 is located on each guide 15.

According to the invention, an annular gasket 31 into which the temple 11 is to be inserted is arranged between the wings 23 of the slider 21 and is rigidly coupled to the slider by being monolithically provided with a tab 32 which also surrounds a portion 21*a*.

The tab 32 is arranged at right angles to the gasket 31 and the slider 21 is arranged therein, by flexing, by inserting one of the wings 23.

A cover 33 covers the upper part of the slider 21, enclosing the tab 32 and leaving exposed only the gasket 31.

The cover 33 is conveniently rigidly coupled to the slider 21 by ultrasound welding or equivalent means.

The gasket 31, together with the tab 32, is preferably made of elastomeric material. The tab is annular just as the gasket.

The temple 11 is therefore retained in the seat defined by the contact surface of the face 14 of the body 12 and by the parallel contact surface defined by the flat portion 22 of the slider 21 once it has irreversibly coupled to the guides 15 after inserting the temple 11 in the gasket 31.

In this case, therefore, the slider 21 is capable of effectively locking rod-like portions having very small cross-section as well as very wide ones without the possibility of unwanted rotations or relative movements or difficulties in locking.

Figure 6:
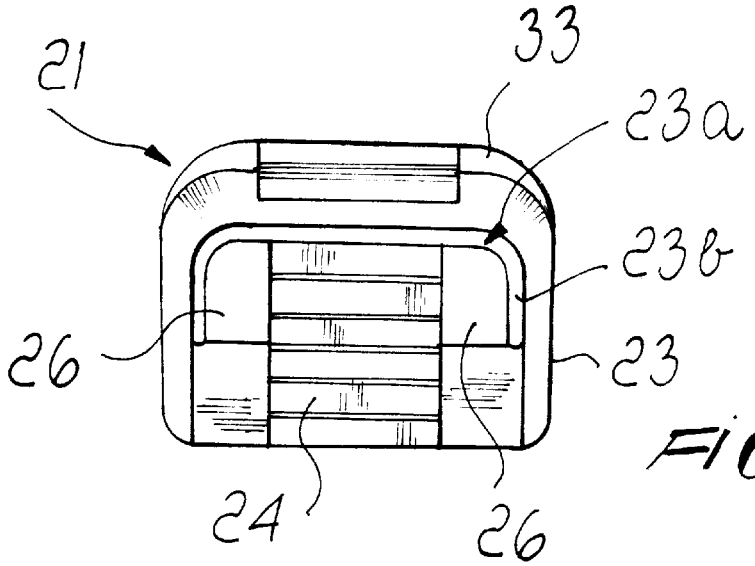
FIG. 6 is a side view of the other component of the seal of FIG. 1.
Figure 7:
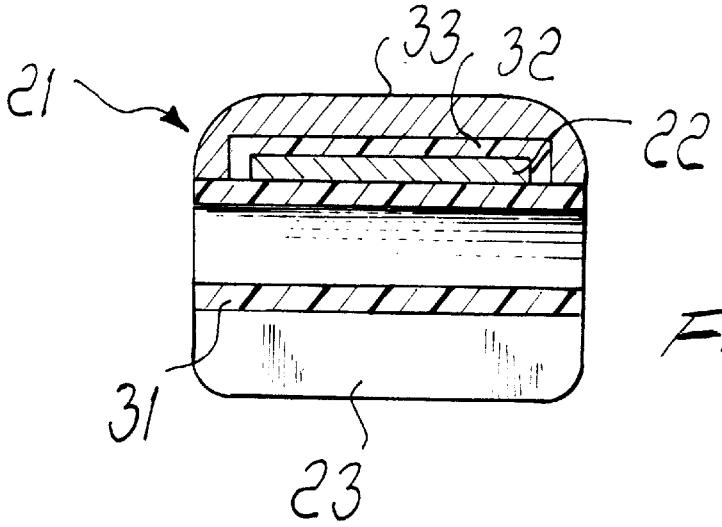
FIG. 7 is a sectional view of the component of FIG. 6.

Moreover, the seal 10 can be reused by employing a disengagement extractor tool, shown schematically in FIG. 6 and designated by the reference numeral 34.

The extractor tool 34 is in fact provided with two pairs of tabs 35 which have wedge-shaped tips, each provided with an abutment region 36 at the part that lies furthest from the points.

The tabs 35 can be inserted in the openings formed, in this case, by the holes 30 until the ends of the wings 23 abut against the abutment regions 36.

Once this has been done, the tabs 35 act on the regions 23*a* of the wings 23 so as to flex them inwardly and simultaneously disengage them from the guides 15.

The saw-tooth portions 24 of the wings 23 in fact disengage from the corresponding saw-tooth portions 16 of the guides 15, thus allowing the uncoupling of the slider 21 and accordingly allowing to open the seal 10.

It should be noted in particular that, differently from conventional seals, the rod-like portion is retained between the slider and the body along a plane which is perpendicular to the contact surface of the temple.

In this manner the effectiveness of the retention is in fact ensured with rod-like portions having any cross-section, even a very small one.

The fact is also noted that the annular gasket 31, rigidly coupled to the slider 21 and therefore to the entire seal 10, makes it impossible to slide the temple 11 off by forcing the gasket 31.

Moreover, the operations for assembling the seal are simplified, since the slider 21 can be preassembled on the temple by simply inserting the temple in the gasket 31 and the rest of the seal 10 can be assembled when required.

Figure 8:
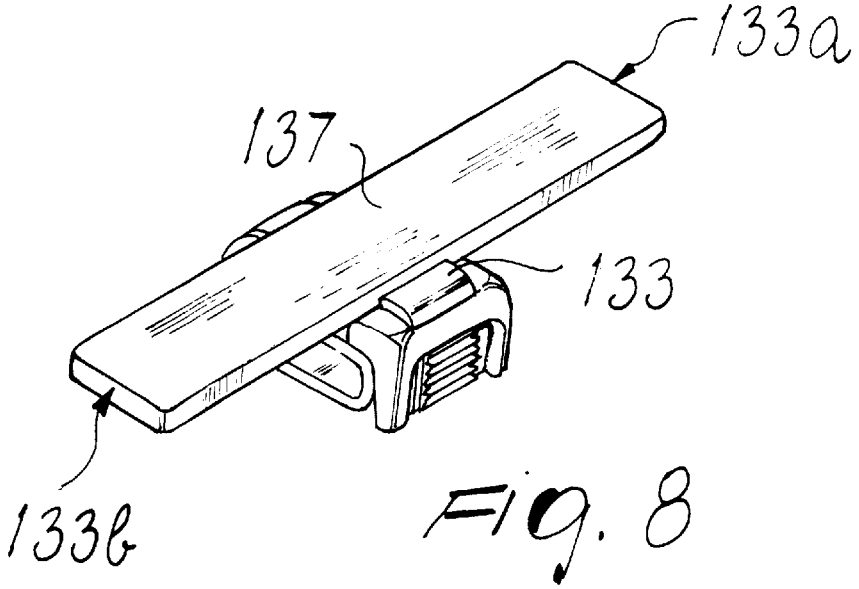
FIG. 8 is a perspective view of a second embodiment of the seal with anti-theft device according to the present invention.

With particular reference to FIG. 8, in a second embodiment of the seal with anti-theft device the cover, now designated by the reference numeral 133, runs parallel to the body 12 with two mutually opposite wings 133*a* which define, as a whole, a flat surface 137 on which it is possible to apply a label 138 with an identification bar code.

In practice it has been found that the present invention fully achieves the intended aim and objects.

An important advantage has been obtained by the present invention in that a seal with anti-theft device has been provided which can be applied to rod-like portions having any cross-section without the possibility of rotations, unwanted movements, locking difficulties or sliding off.

Another important advantage is certainly also that an optionally fully reusable seal has been provided.

Another advantage of the present invention is that it provides a seal with anti-theft device whose cost is fully comparable to that of conventional models.

The present invention is susceptible of numerous modifications and variations, all of which are within the scope of the same inventive concept.

All the details may be replaced with other technically equivalent is elements.

The materials used, so long as they are compatible with the contingent use, as well as the dimensions, may also be any according to requirements.

The disclosures in Italian Patent Application No. PD98A000211 from which this application claims priority are incorporated herein by reference.

What is claimed is:

1. A seal with anti-theft device for items having rod-like portions, comprising a hollow body suitable to contain an electronic signaling component and defining a contact surface for a rod-like portion, two parallel and mutually opposite guides protruding from said body, each guide having at least one saw-tooth engagement surface for the irreversible sliding, at right angles to the contact surface, of a slider which has complementary saw-tooth engagement surfaces, said rod-like portion being retained between said contact surface and a parallel contact surface defined by said slider, an annular gasket, in which said rod-like portion is to be inserted, being arranged between said saw-tooth engagement surfaces of said slider and being rigidly coupled to said slider by being monolithically provided with an annular tab surrounding a portion of said slider.

2. A seal with anti-theft device for items having rod-like portions, comprising a hollow body suitable to contain an electronic signaling component and defining a contact surface for a rod-like portion, two parallel and mutually opposite guides protruding from said body, each guide having at least one saw-tooth engagement surface for the irreversible sliding, at right angles to the contact surface, of a slider which has complementary saw-tooth engagement surfaces, said rod-like portion being retained between said contact surface and a parallel contact surface defined by said slider, wherein an annular gasket, in which said rod-like portion is to be inserted, is arranged between said saw-tooth engagement surfaces of said slider and is rigidly coupled thereto by being monolithically provided with an annular tab surrounding a portion thereof, said slider comprising wings which cantilever out and on which said complementary saw-tooth surfaces are defined at outward faces, said wings being flexible, said portion surrounded by said tab of said gasket being defined between said wings.

3. The seal according to claim 2, wherein said tab of said gasket is enclosed by a cover which is applied and rigidly coupled to said slider.

4. The seal according to claim 3, wherein said cover is provided with mutually opposite wings which define, as a whole, a surface for applying a label.

5. A seal with anti-theft device for items having rod-like portions, comprising a hollow body suitable to contain an electronic signaling component and defining a contact surface for a rod-like portion, two parallel and mutually opposite guides protruding from said body, each guide having at least one saw-tooth engagement surface for the irreversible sliding, at right angles to the contact surface, of a slider which has complementary saw-tooth engagement surfaces, said rod-like portion being retained between said contact surface and a parallel contact surface defined by said slider, wherein an annular gasket, in which said rod-like portion is to be inserted, is arranged between said saw-tooth engagement surfaces of said slider and is rigidly coupled thereto by being monolithically provided with an annular tab surrounding a portion thereof, said tab being arranged at right angles to said gasket.

6. The seal according to claim 1, wherein said gasket is made of elastomeric material.

* * * * *